US010085550B1

(12) United States Patent
Hsu et al.

(10) Patent No.: US 10,085,550 B1
(45) Date of Patent: Oct. 2, 2018

(54) SINGLE LEVER-OPERATED HEIGHT-ADJUSTABLE TABLE

(71) Applicant: CHEN-SOURCE INC., Taoyuan (TW)

(72) Inventors: Chung-Jong Hsu, Taoyuan (TW); Te-Jung Yuan, Taoyuan (TW)

(73) Assignee: CHEN-SOURCE INC., Guishan District, Taoyuan (TW)

( * ) Notice: Subject to any disclaimer, the term of this patent is extended or adjusted under 35 U.S.C. 154(b) by 0 days.

(21) Appl. No.: 15/670,442

(22) Filed: Aug. 7, 2017

(51) Int. Cl.
*A47B 9/16* (2006.01)
*A47B 9/18* (2006.01)

(52) U.S. Cl.
CPC ..... *A47B 9/16* (2013.01); *A47B 2009/185* (2013.01); *A47B 2200/0035* (2013.01)

(58) Field of Classification Search
CPC ..... A47B 9/00; A47B 9/16
USPC ..... 108/145, 147, 144.11; 248/421, 157, 248/422; 254/122
See application file for complete search history.

(56) References Cited

U.S. PATENT DOCUMENTS 165,885 A * 7/1875 Sloan ..... A47B 9/16 108/116
730,451 A * 6/1903 Friend ..... A47K 10/424 108/145
1,034,443 A * 8/1912 Hathaway ..... A47B 9/00 108/145
3,116,910 A * 1/1964 Moore ..... A47B 51/00 254/122
3,326,527 A * 6/1967 Jenkins ..... B66F 3/22 254/122
4,624,437 A * 11/1986 Sakamoto ..... B60N 2/502 108/145
4,747,353 A * 5/1988 Watt ..... A47B 9/02 108/145
5,402,737 A * 4/1995 Kanazawa ..... A47B 9/16 108/147
7,677,518 B2 * 3/2010 Chouinard ..... A47B 21/02 108/10
8,052,120 B2 * 11/2011 Bacon ..... B66F 7/0625 180/168
9,289,058 B2 * 3/2016 Flaherty ..... A47B 9/16

* cited by examiner

*Primary Examiner* — Jose V Chen
(74) *Attorney, Agent, or Firm* — Muncy, Geissler, Olds & Lowe, P.C.

(57) ABSTRACT

A single lever-operated height-adjustable table includes a table top with two bottom guide rails, a base plate, a linkage system including two scissors linkages, two pairs of coupling rods pivotally coupled between the scissors linkages and the base plate and loaded with torsion springs and sliding roller sets respectively pivotally connected to the scissors linkages by respective pivot bolts and rotatably movably mounted in the guide rails, and a lifting control system for controlling lifting of the table top through one single operating lever.

7 Claims, 12 Drawing Sheets

SINGLE LEVER-OPERATED HEIGHT-ADJUSTABLE TABLE

BACKGROUND OF THE INVENTION

1. Field of the Invention

The present invention relates to tables and more particularly, to a single lever-operated height-adjustable table, which comprises a single lever-operated height-adjustable table includes a table top with two bottom guide rails, a base plate, a linkage system including two scissors linkages, two pairs of coupling rods pivotally coupled between the scissors linkages and the base plate and loaded with torsion springs and sliding roller sets respectively pivotally connected to the scissors linkages by respective pivot bolts and rotatably movably mounted in the guide rails, and a lifting control system for controlling lifting of the table top through one single operating lever.

2. Description of the Related Art

Tables are commonly used in offices, home life, schools and workstations. Different types of tables, such as computer tables, work tables, office tables, folding tables, dinner tables, etc., are used for different applications. In order to provide users with a larger table top area, in addition to retractable designs, folding collapsible tables are also commercially available for choice. A folding collapsible table can be freely opened or closed. When collapsed, the dimension of a collapsed folding collapsible table is significantly reduced and conveniently for delivery and storage. So, folding collapsible tables are widely invited by consumers.

Further, regular commercial tables have fixed length, width and height, and are applicable to people around average height. However, taller or shorter people will feel uncomfortable when using a table designed for people of average height. There are height-adjustable chairs commercially available that fit different sizes of tables. However, due to limited adjusting range, these commercial height-adjustable chairs cannot fit all sizes of tables. When using a chair or table, people usually will condescend to take the existing chair or table without considering height matching. It will be very inconvenient for large size people to use a regular size chair or table.

People spend a lot of time in using tables and chairs in everyday life. Sitting on the seat for a long period of time can easily lead to back and cervical pain, and the heart rate, metabolic rate, insulin efficacy and high cholesterol levels will decline, so that the incidence of cardiovascular disease, depression and diabetes will be significantly increased. In order to reduce the risk of obesity and to improve metabolic problems and cardiovascular disease, the wave of standing at work has been set off in recent years. More important, in addition to making your body healthy, standing at work can also improve work efficiency and productivity. Therefore, height-adjustable tables are created to meet the need of standing at work. Further, commercial tables commonly have a fixed size and do not allow for adjustment. Although folding collapsible tables can be received to reduce the size convenient for delivery and storage, conventional folding collapsible tables are not adjustable or not conveniently adjustable to fit people of different body types. Using a table and chair set that does not fit the body type of the user can cause the user to sit with bad posture. Because most commercial tables are not adjustable in height, they are not ergonomically engineered to fit people of different body types and to satisfy different application requirements. An improvement is needed.

Therefore, it is desirable to provide a table that allows easy and rapid adjustment of the elevation of the table top to fit people of different body shapes.

SUMMARY OF THE INVENTION

The present invention has been accomplished under the circumstances in view. It is the main object of the present invention to provide a single lever-operated height-adjustable table, which allows adjustment of the elevation of the table top rapidly and smoothly with less effort, ensuring structural stability.

To achieve this and other objects of the present invention, a single lever-operated height-adjustable table comprises a table top with two bottom guide rails, a base plate, a linkage system including two scissors linkages, two pairs of coupling rods pivotally coupled between the scissors linkages and the base plate and loaded with torsion springs and sliding roller sets respectively pivotally connected to the scissors linkages by respective pivot bolts and rotatably movably mounted in the guide rails, and a lifting control system for controlling lifting of the table top through one single operating lever. When the user biases the operating lever of the control unit of the lifting control system, the arched engagement member of the lifting control system is disengaged from the center gear of the locking mechanism of the lifting control system. At this time, the torsion springs of the linkage system and the meshed coupling gears at the bottom sides of the coupling rods stabilize rapid rising of the scissors linkages. At the same time, the center gear drives the first gear rack and second gear rack of the lifting control system to move in reversed directions and to carry the sliding roller sets along the respective guide rails, and thus, the table top can be smoothly lifted to the desired elevation with less effort.

Further, when the two coupling rods at each scissors linkage of the linkage unit are biased inwardly toward each other or outwardly away from each other, the meshed coupling gears drive the respective scissors linkage to perform a scissors action at an equal angle or speed relative to the respective scissors linkage, keeping the respective scissors linkage in balance and preventing deviation of the linkage unit. The arrangement of the base plate and the linkage unit constitutes the desired single lever-operated linkage system, enhancing table top moving stability and adjustment reliability. When lowering the linkage unit, the coupling rods are forced against the torsion springs to buffer the lowering speed of the table top, preventing the table top from striking against the base plate accidentally, allowing the sliding roller sets of the sliding roller unit to reciprocate smoothly.

Further, after adjustment of the table top to the desired height, release the operating lever of the control unit, allowing the buffer device to return the operating lever to its previous position and to simultaneously bias the arched engagement member in forcing the pawl into engagement with the center gear and the positioning slot of the bracket, and thus, the center gear is locked and prohibited from rotation by the arched engagement member. When the center gear is locked, the first gear rack and the second gear rack are prohibited from relative movement, and thus, the sliding roller sets of the sliding roller unit are locked in the sliding chambers of the guide rail, enabling the linkage unit to support the table top on the base plate at the adjusted height.

Other advantages and features of the present invention will be fully understood by reference to the following specification in conjunction with the accompanying drawings, in which like reference signs denote like components of structure.

DETAILED DESCRIPTION OF THE PREFERRED EMBODIMENT

Figure 1:
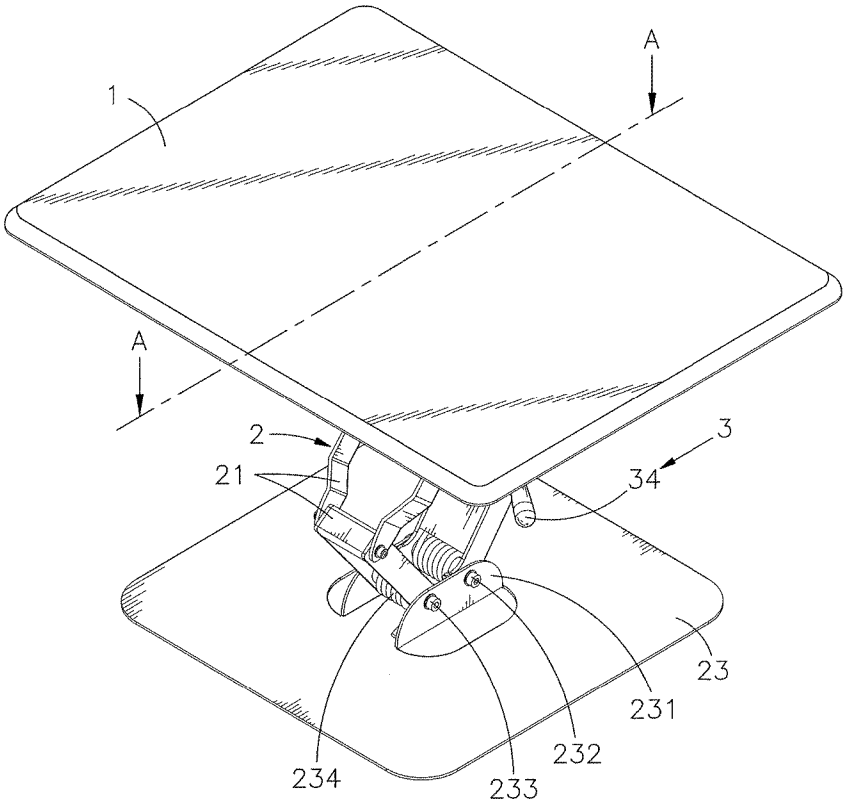
FIG. 1 is an oblique top elevational view of a single lever-operated height-adjustable table in accordance with the present invention.
Figure 2:
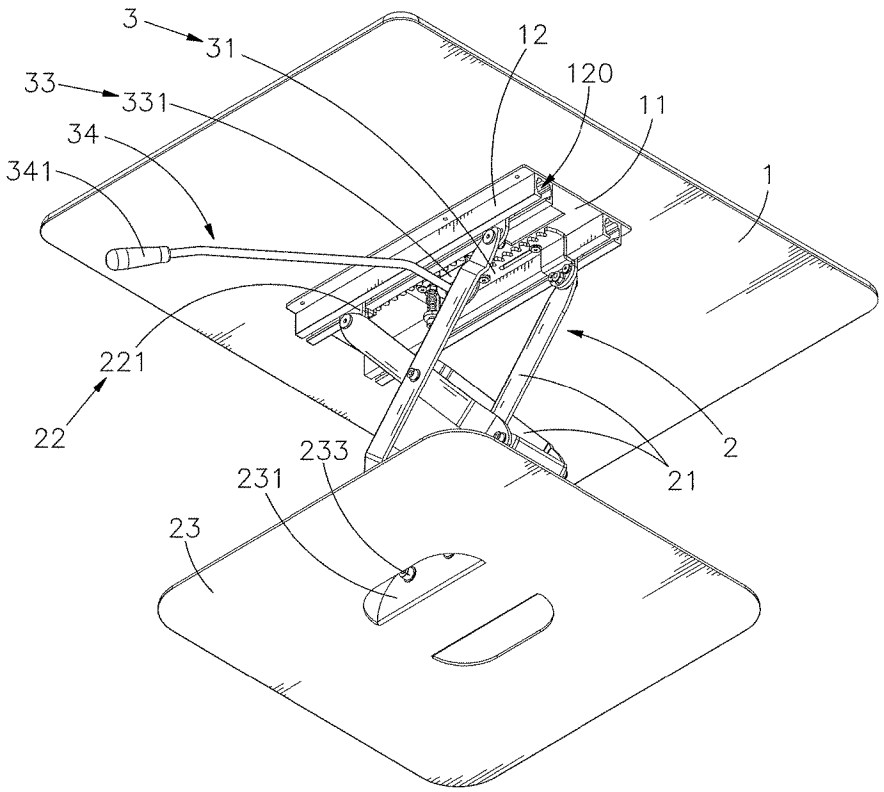
FIG. 2 is an oblique bottom elevational view of the single lever-operated height-adjustable table in accordance with the present invention.
Figure 3:
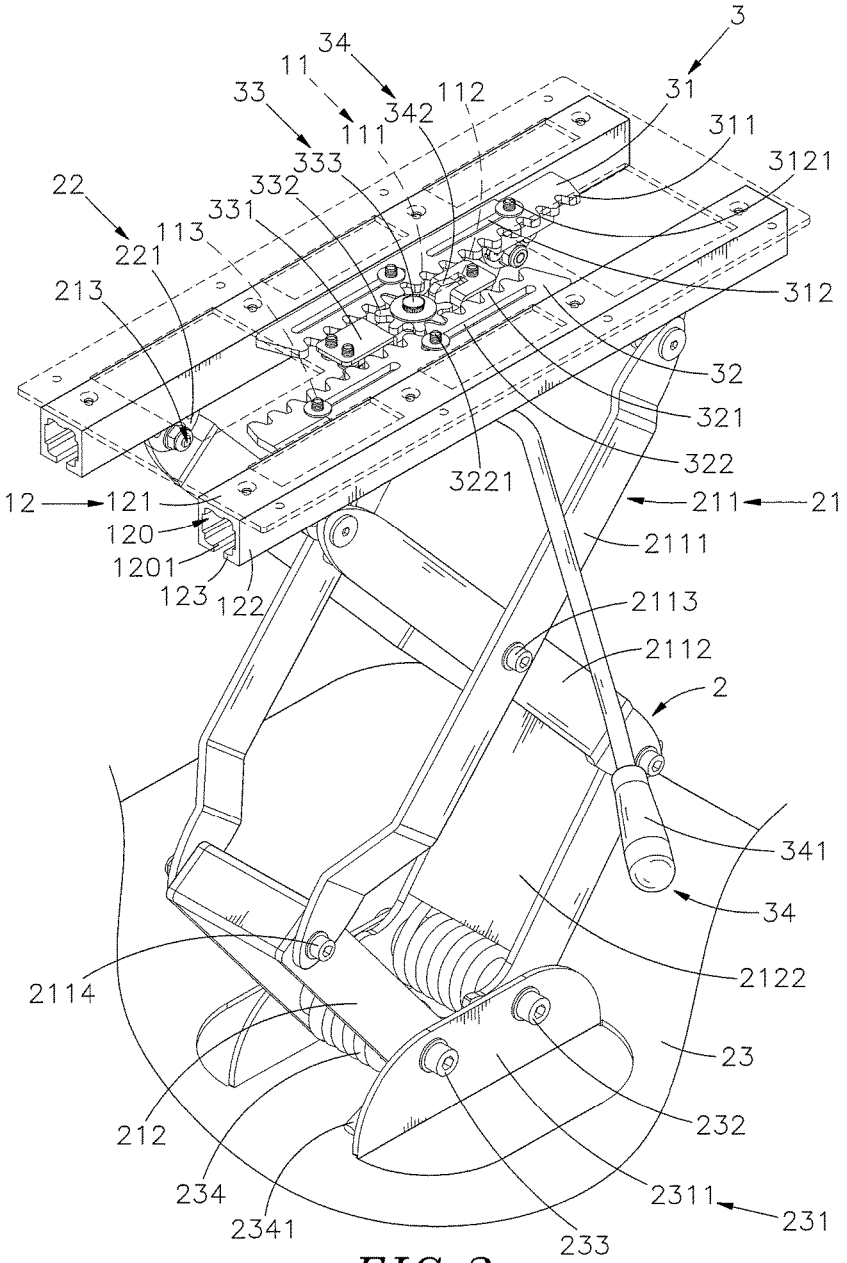
FIG. 3 is a perspective view of a part of the single lever-operated height-adjustable table in accordance with the present invention.
Figure 4:
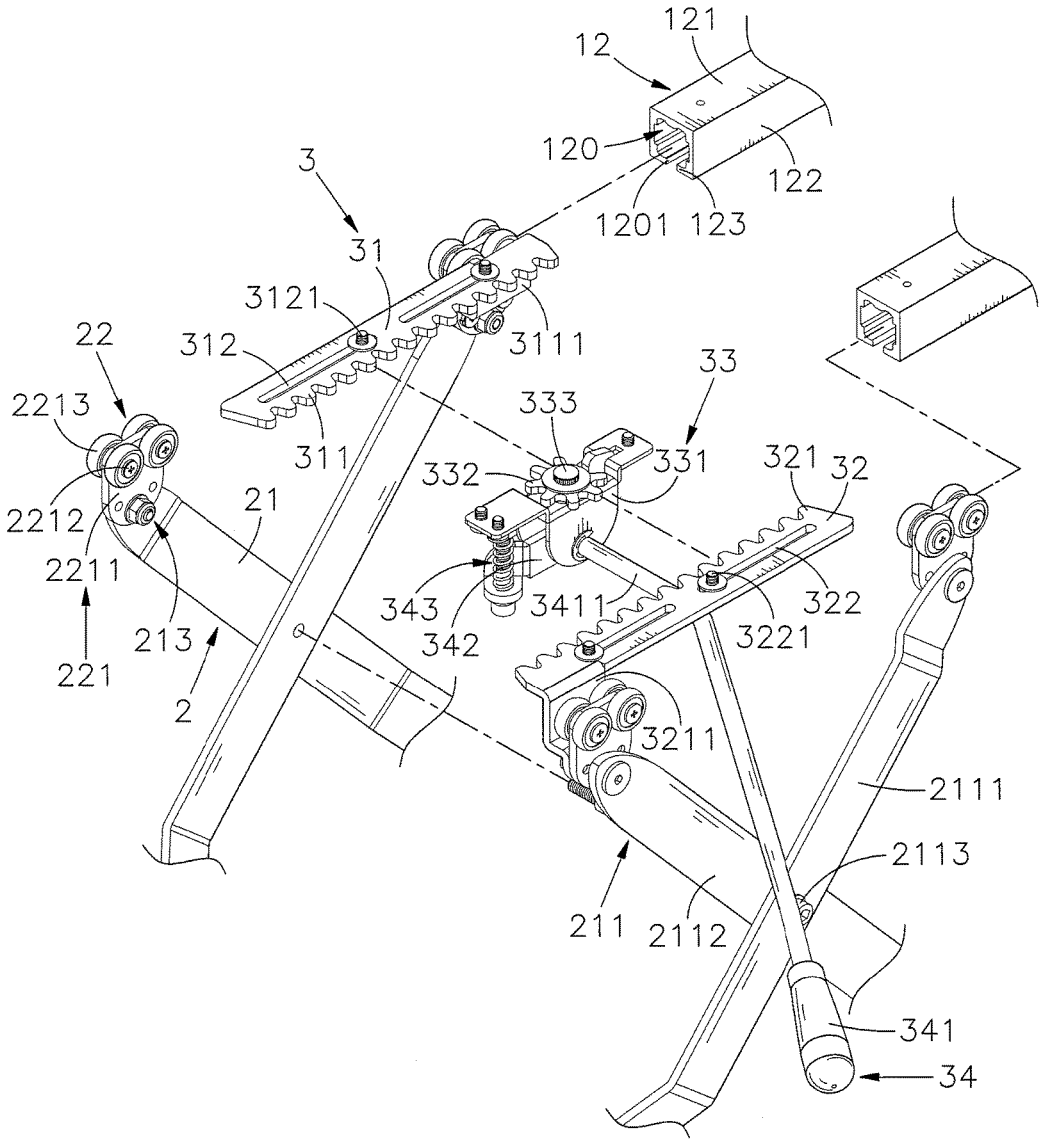
FIG. 4 is an exploded view of a part of the single lever-operated height-adjustable table in accordance with the present invention.
Figure 5:
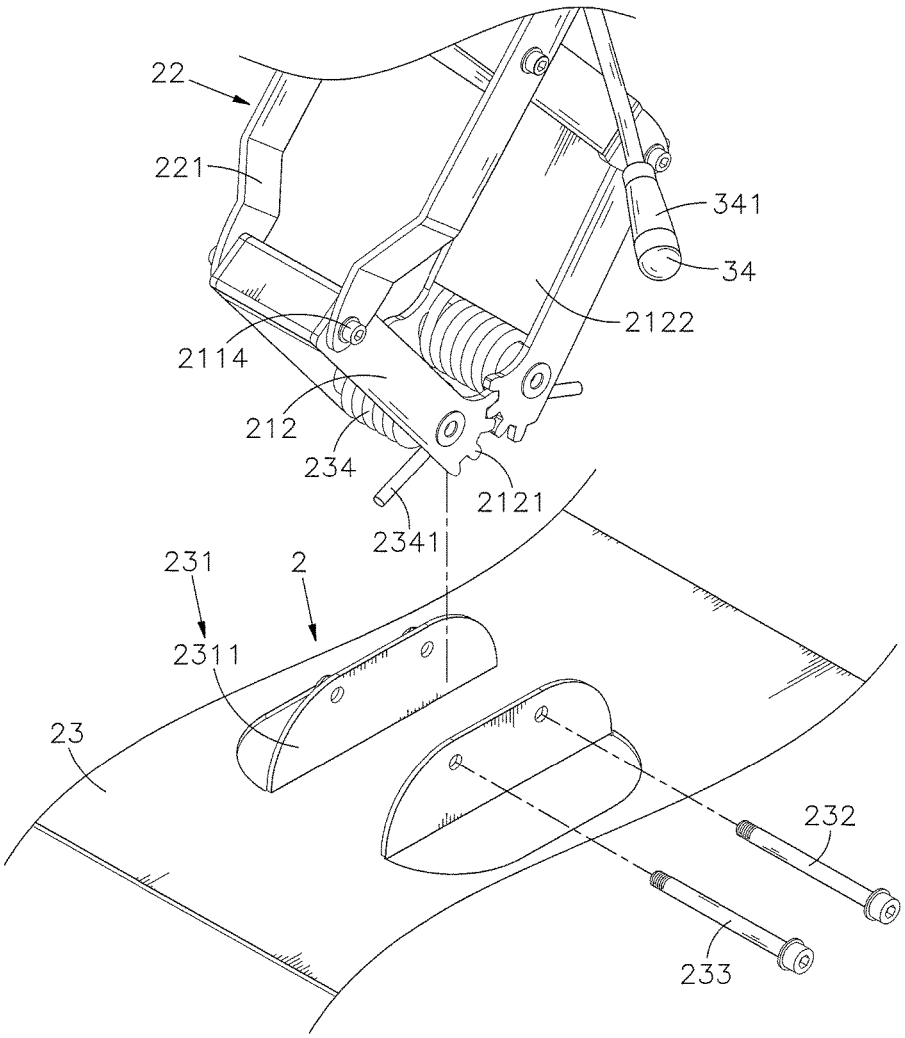
FIG. 5 is an exploded view of the linkage unit and base plate of the linkage system of the single lever-operated height-adjustable table in accordance with the present invention.
Figure 6:
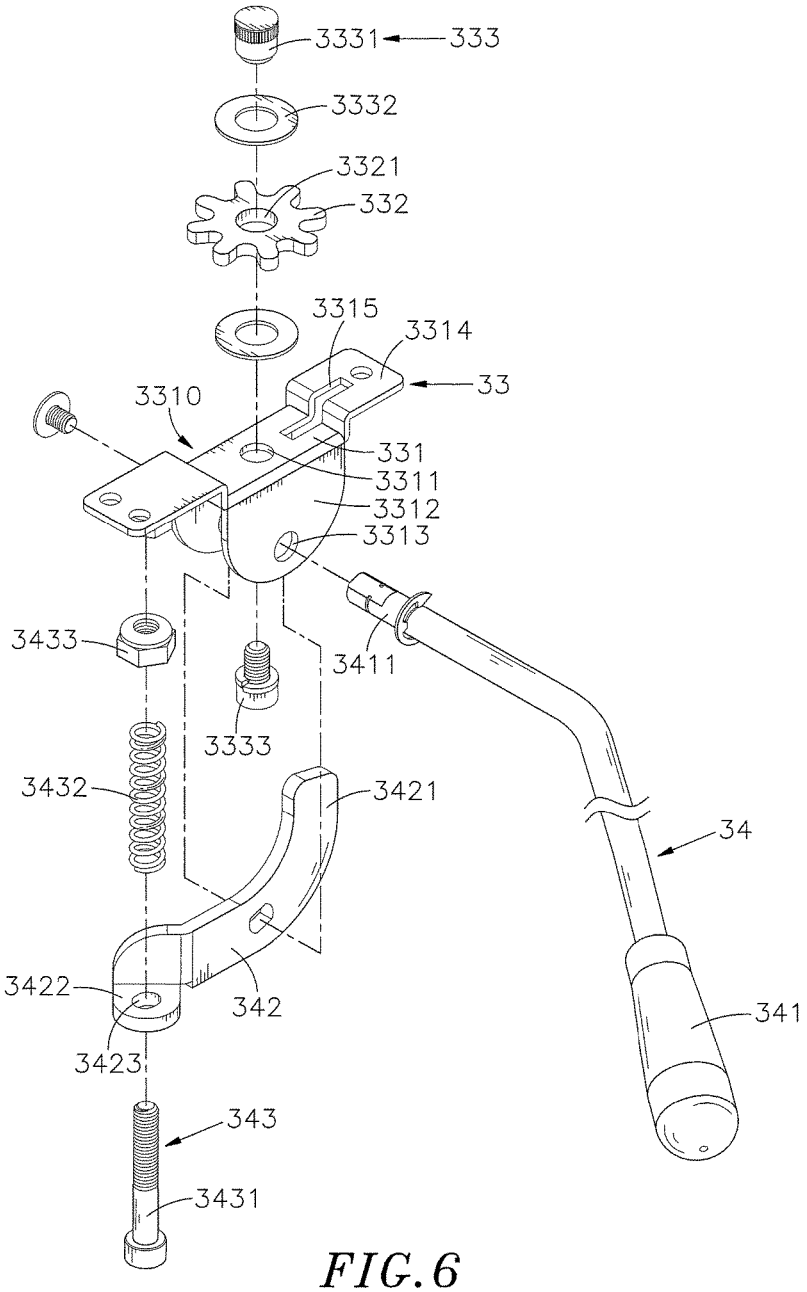
FIG. 6 is an exploded view of the locking mechanism and control unit of the lifting control system of the single lever-operated height-adjustable table in accordance with the present invention.

Referring to FIGS. 1-6, a single lever-operated height-adjustable table in accordance with the present invention is shown. The single lever-operated height-adjustable table comprises a table top 1, a linkage system 2 and a lifting control system 3.

The table top 1 comprises a mount 11 fixedly located at the center of a bottom surface thereof, and two guide rails 12 respectively mounted at the mount 11 at opposing left and right sides in a parallel manner. The mount 11 comprises a mounting hole 111 located at the center thereof and equally spaced between the two guide rails 12, and an elongated position-limiting hole 112 and a plurality of screw holes 113 spaced around the mounting hole 111. The guide rail 12 comprises a top panel 121 affixed to the mount 11, two side panels 122 respectively and vertically downwardly extended from two opposite lateral sides of the top panel 121, two guide flanges 123 respectively and horizontally inwardly extended from respective bottom sides of the two side panels 122 toward each other, a sliding chamber 120 surrounded by the top panel 121, the two side panels 122 and the two guide flanges 123, and an elongated open slot 1201 defined between the two guide flanges 123 in communication with the sliding chamber 120.

The linkage system 2 comprises a linkage unit 21 mounted at a bottom side of the mount 11, a sliding roller unit 22 mounted at a top side of the linkage unit 21 and slidably coupled to the guide rails 12, and a base plate 23 coupled with an opposing bottom side of the linkage unit 21. The linkage unit 21 comprises two scissors linkages 211 each comprising a first link 2111, a second link 2112 and a center pivot 2113 pivotally connecting the first link 2111 and the second link 2112 into a criss-cross 'X' pattern, and two pairs of coupling rods 212 respectively pivotally connected with respective top ends thereof to respective bottom ends of the first links 2111 and the second links 2112 of the scissors linkages 211 by respective bottom pivot bolts 2114. The coupling rods 212 have respective opposing bottom ends thereof respectively terminating in a coupling gear 2121. The coupling gears 2121 of each pair of coupling rods 212 are meshed together. Further, the coupling gears 2121 can be sector gears or curved gear racks. Further, each coupling rod 212 comprises a side flange 2122 located at an inner side thereof. The sliding roller unit 22 comprises sliding roller sets 221 respectively pivotally connected to the top ends of the first links 2111 and the second links 2112 of the scissors linkages 211 of the linkage unit 21 by respective pivot bolts 213. Each sliding roller set 221 comprises a mounting plate 2211 pivotally connected to the top end of the first link 2111 or the second link 2112 of the respective scissors linkage 211 by the respective pivot bolt 213 and inserted through the elongated open slot 1201 of the one respective guide rail 12 into the inside of the respective sliding chamber 120, a plurality of wheel axles 2212 respectively transversely mounted at the mounting plate 2211, a plurality of rollers 2213 respectively rotatably mounted on opposing ends of the wheel axles 2212 and rotatably supported on the guide flanges 123 in the sliding chamber 120 of the respective guide rail 12.

The base plate 23 comprises a coupling rod supporting rack 231 located at a center area of a top wall thereof for supporting the linkage unit 21. The coupling rod supporting rack 231 comprises two upright supporting plates 2311 arranged in parallel, a first pivot axle 232 and a second pivot axle 233 transversely mounted at the two upright supporting plates 2311 in a parallel manner and respectively inserted through the coupling gears 2121 of the coupling rods 212 of the linkage unit 21 to pivotally connect the coupling gears 2121 to the upright supporting plates 2311, and two torsion springs 234 respectively mounted on the first pivot axle 232 and the second pivot axle 233 with respective opposite end pieces 2341 thereof respectively stopped at the top wall of the base plate 23 and the side flanges 2122 of the respective coupling rods 212 to impart an elastic restoring force to the linkage unit 21.

The lifting control system 3 comprises a first gear rack 31 and a second gear rack 32 arranged in parallel between the two guide rails 12 beneath the mount 11 with respective series of teeth 311, 321 facing toward each other, two connection plates 3111, 3211 respectively downwardly extended from one end of the first gear rack 31 and one end of the second gear rack 32 in a diagonal manner and respectively connected to the mounting plates 2211 of the sliding roller sets 221 at the second links 2112 of the scissors linkages 211. Further, at least one first sliding slot 312 and at least one second sliding slot 322 are respectively longitudinally formed in the first gear rack 31 and the second gear rack 32. In the present preferred embodiment, the two first sliding slots 312 and the two second sliding slots 322 are respectively longitudinally formed in the first gear rack 31 and the second gear rack 32 and respectively aligned in line.

Guide screws 3121, 3221 are respectively inserted through the first sliding slots 312 and the second sliding slot 322 and threaded into the respective screw holes 113 of the mount 11 to secure the first gear rack 31 and the second gear rack 32, allowing the first gear rack 31 and the second gear rack 32 to be moved linearly relative to the mount 11.

The lifting control system 3 further comprises a locking mechanism 33 disposed between the first gear rack 31 and the second gear rack 32. The locking mechanism 33 comprises a bracket 331, a center gear 332 pivotally mounted at the center of the bracket 331. The bracket 331 comprises a first axle hole 3311 vertically cut through a top wall thereof, two side panels 3312 respectively downwardly extended from two opposite lateral sides of the top wall in a parallel manner, a second axle hole 3313 transversely cut through the two side panels 3312, two horizontal mounting lugs 3314 respectively extended from opposing front and rear sides of the top wall and fastened to the mount 11, a positioning slot 3315 cut through the front-sided horizontal mounting lug 3314, and a top accommodation space 3310 defined between the two horizontal mounting lugs 3314 above the top wall of the bracket 331 for accommodating the center gear 332.

In the present preferred embodiment, the center gear 332 is meshed between the series of teeth 311 of the first gear rack 31 and the series of teeth 321 of the second gear rack 32 and rotatable to move the first gear rack 31 and the second gear rack 32 in reversed directions. The center gear 332 defines a center gear hole 3321 pivotally connected to the first axle hole 3311 of the bracket 331 by a pivoting device 333. The pivoting device 333 comprises a screw nut 3331 riveted to the mounting hole 111 of the mount 11, a plurality of washers 3332 respectively mounted on opposing top and bottom sides of the center gear 332, and a screw 3333 upwardly inserted through the first axle hole 3311 of the bracket 331, the center gear hole 3321 of the center gear 332 and the washers 3332 and threaded into the screw nut 3331 to pivotally connect the center gear 332 to the bracket 331.

The lifting control system 3 further comprises a control unit 34 connected to the locking mechanism 33. The control unit 34 comprises an operating lever 341 suspending outside the mount 11 and rotatable in a direction parallel to the length of the guide rails 12, a coupling axle 3411 axially extended from a distal end of the operating lever 341 and pivotally connected to the second axle hole 3313, an arched engagement member 342 fastened to the coupling axle 3411 and suspending between the two side panels 3312 and having a pawl 3421 located at a top end thereof an insertable through the positioning slot 3315 into engagement with the center gear 332 to stop the center gear 332 from rotation and a bearing portion 3422 perpendicularly extended from an opposing bottom end thereof with a through hole 3423 defined therein, and a buffer device 343 mounted in the through hole 3423. The buffer device 343 comprises a push bolt 3431 upwardly inserted through the through hole 3423, a spring member 3432 mounted around the push bolt 3431 and supported on the bearing portion 3422, and a screw nut 3433 threaded onto the push bolt 3431. The spring member 3432 is stopped between the bearing portion 3422 and the screw nut 3433 to impart a pressure to the screw nut 3433 against the rear-sided horizontal mounting lug 3314 of the bracket 331. Thus, the arched engagement member 342 is normally held in a locking position with the pawl 3421 inserted through the positioning slot 3315 and engaged with the center gear 332 to stop the center gear 332 from rotation.

Figure 7:
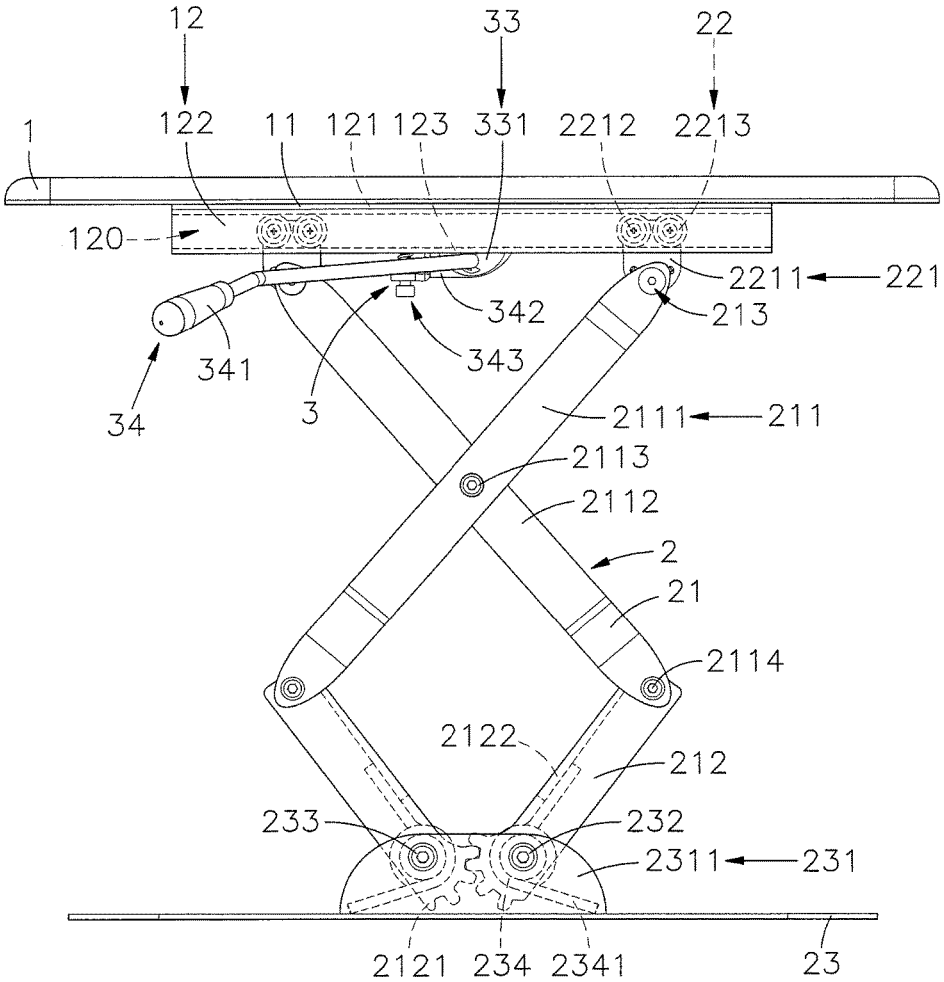
FIG. 7 is a schematic side view of the single lever-operated height-adjustable table in accordance with the present invention.
Figure 8:
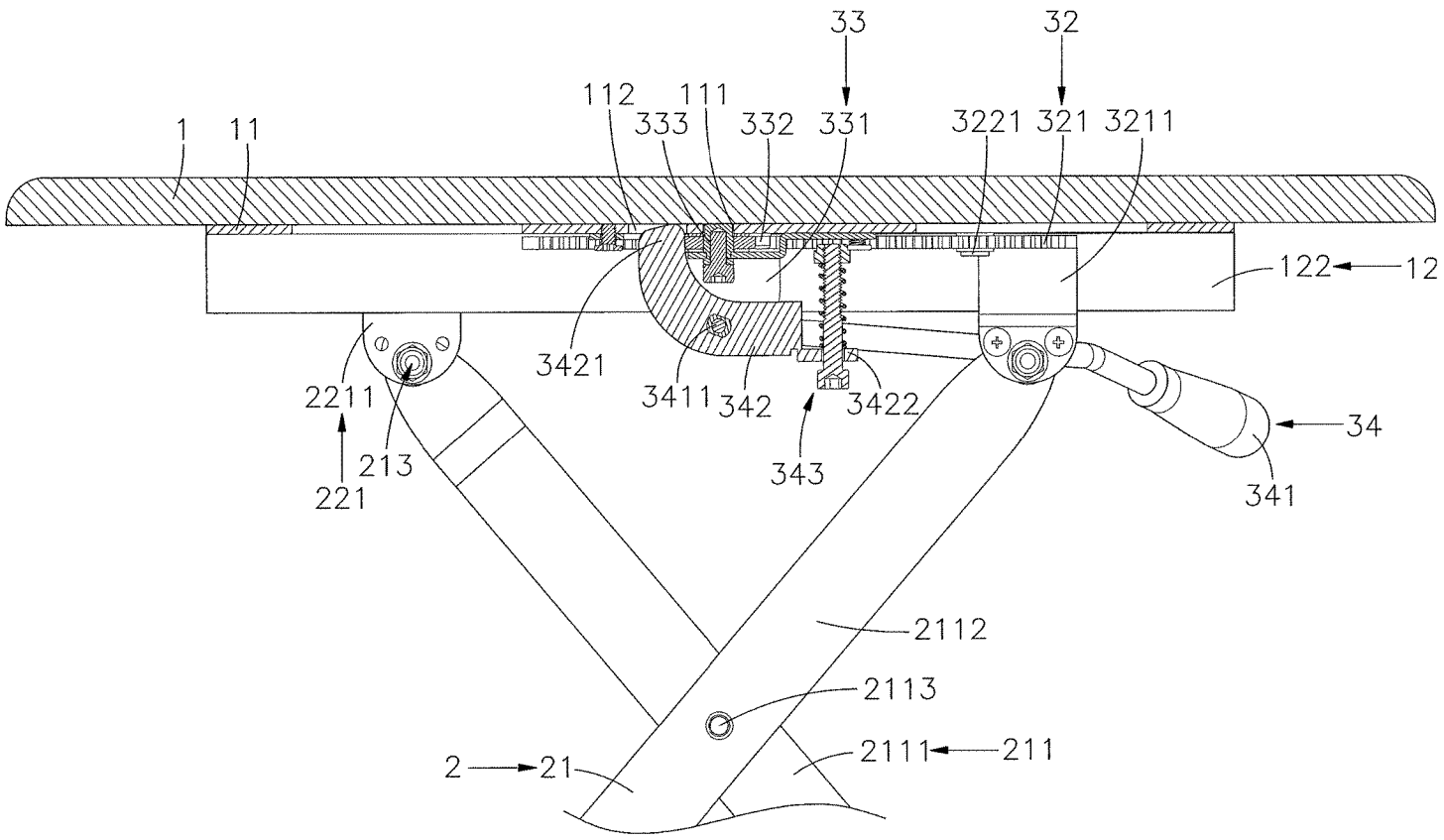
FIG. 8 is a sectional view taken along line A-A of FIG. 1.
Figure 9:
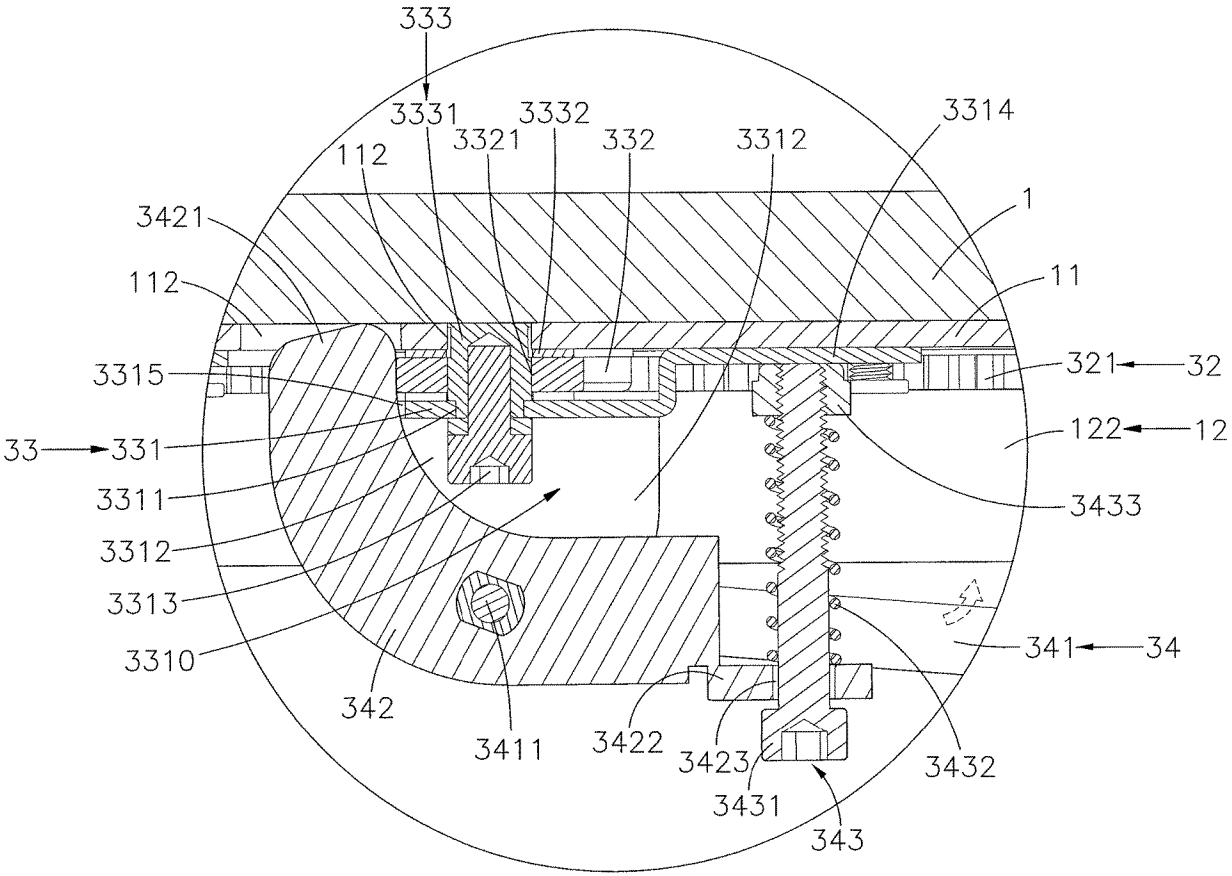
FIG. 9 corresponds to FIG. 8, illustrating the control unit operated and the arched engagement member biased.
Figure 10:
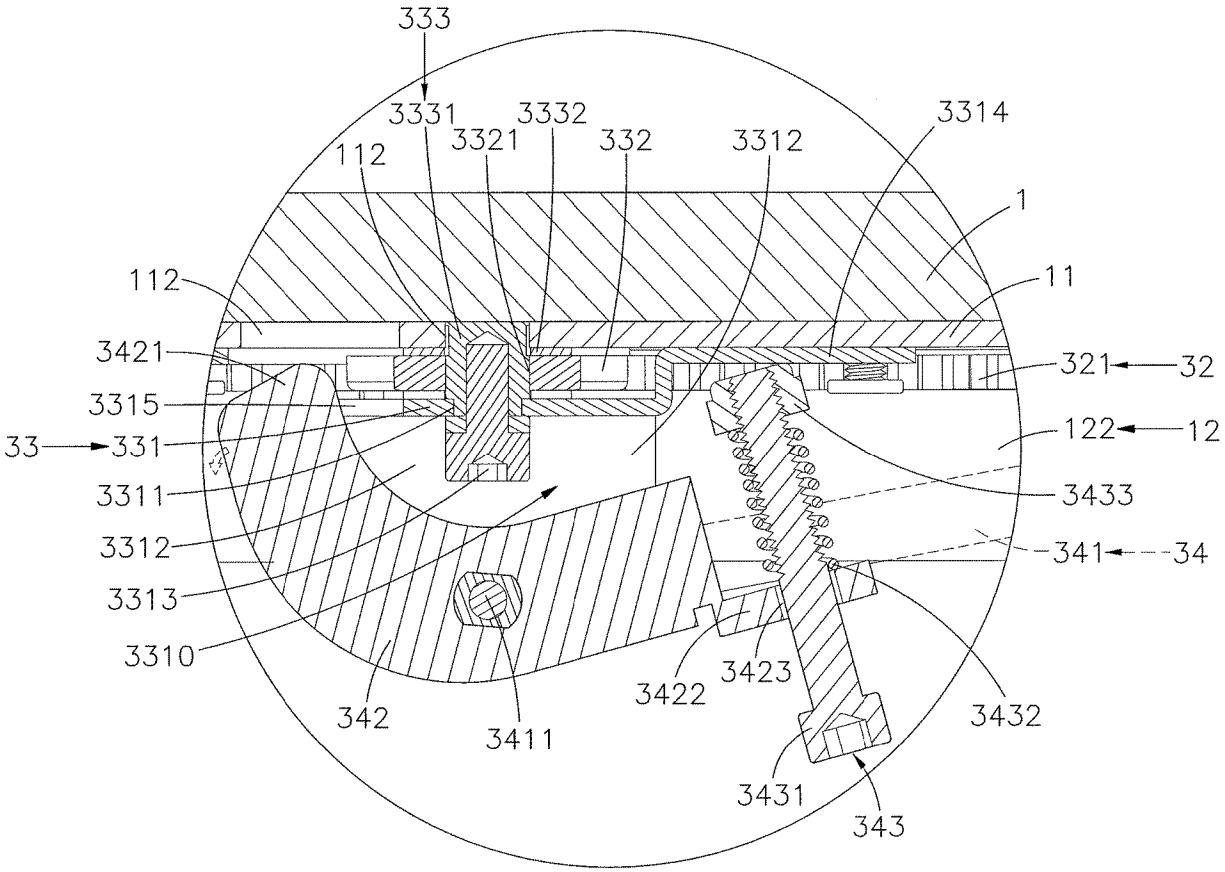
FIG. 10 corresponds to FIG. 9, illustrating the arched engagement member disengaged from the center gear.
Figure 11:
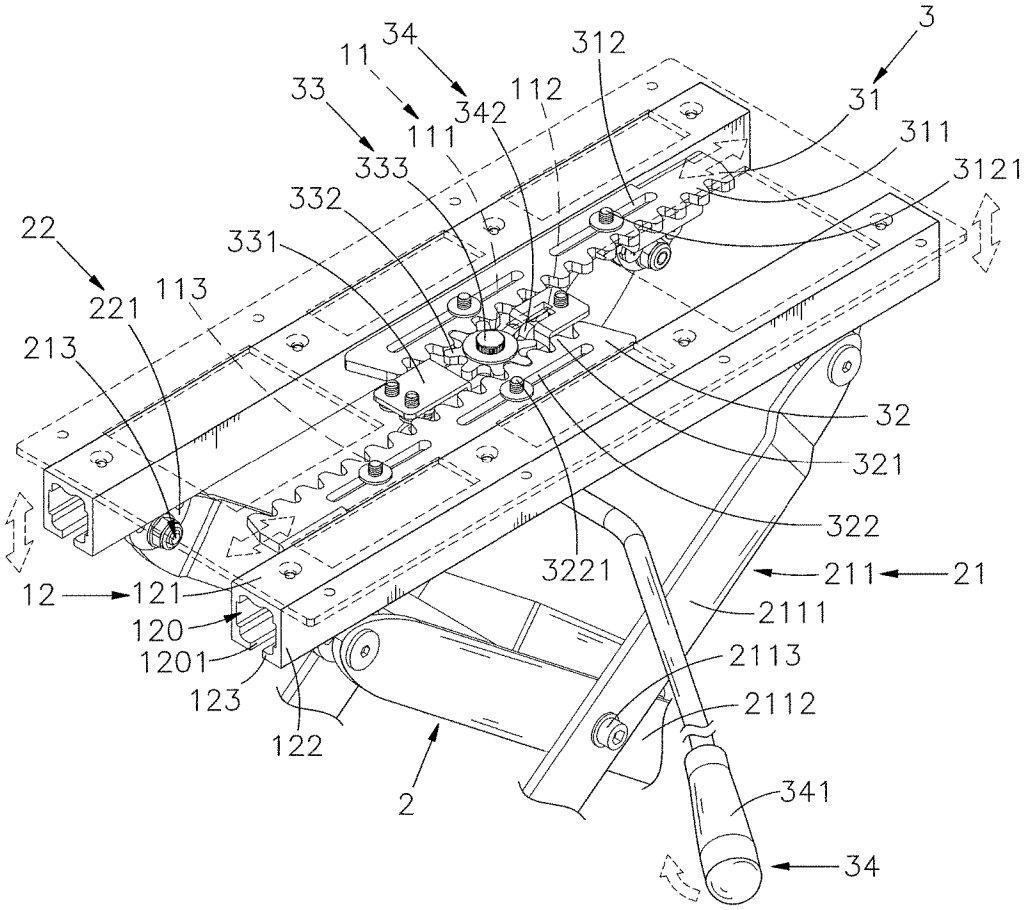
FIG. 11 corresponds to FIG. 3. Illustrating the elevation of the table top adjusted.
Figure 12:
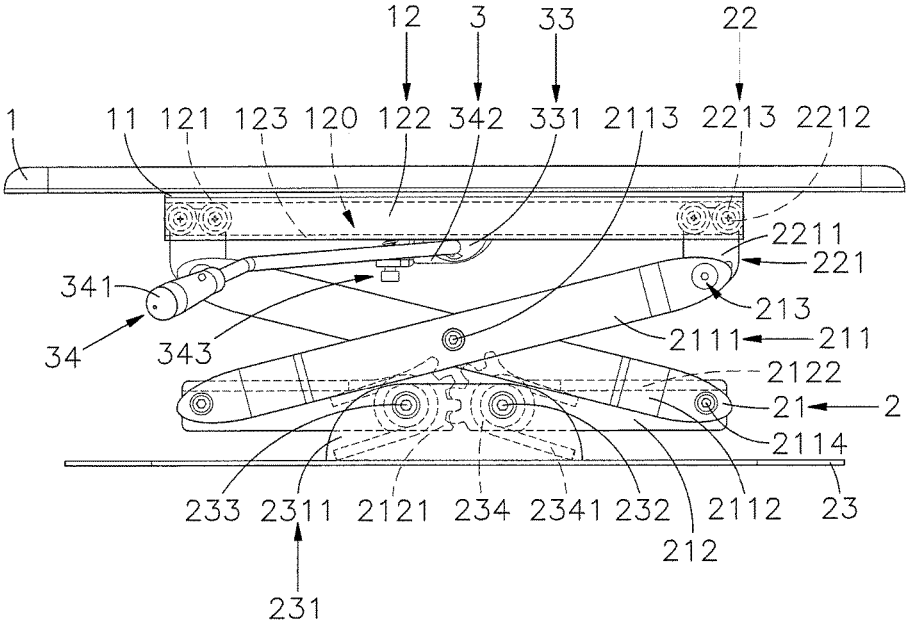
FIG. 12 is a schematic side view of the present invention, illustrating the linkage system collapsed.

Referring to FIGS. 7-12, when the user is going to adjust the height of the table top 1, attach the palm of one hand to one side edge of the tabletop 1 and then operate the fingers of the same hand to bias the operating lever 341 of the control unit 34 upward relative to the table top 1, driving the coupling axle 3411 to bias the arched engagement member 342 in moving the pawl 3421 downwardly away from the center gear 332 and the positioning slot 3315 of the bracket 331. At this time, the center gear 332 is released from the constraint of the pawl 3421 for free rotation, and the bearing portion 3422 of the arched engagement member 342 is moved upward to compress the spring member 3432 of the buffer device 343. After unlocked the center gear 332, the user can push down or lift the table top 1 to upwardly extend out or downwardly collapse the linkage unit 21 of the linkage system 2, thereby adjusting the table top 1 to the desired height.

During movement of the linkage unit 21 of the linkage system 2, the pivot bolts 213 are forced by the scissors linkages 211 to move the sliding roller sets 221 of the sliding roller unit 22 forward or backward in the sliding chambers 120 of the respective guide rails 12, and the coupling rods 212 are forced by the scissors linkages 211 to turn inwards or outwards about the first pivot axle 232 and the second pivot axle 233 of the base plate 23 in compressing or releasing the torsion springs 234. Thus, the scissors linkages 211 of the linkage unit 21 of the linkage system 2 are forced to perform a scissors action when the user biases the operating lever 341 of the control unit 34. Further, during biasing of the coupling rods 212, the meshed coupling gears 2121 stabilize the scissors action of the scissors linkages 211 of the linkage unit 21; the rollers 2213 of the sliding roller sets 221 of the sliding roller unit 22 are moved along the guide flanges 123 of the respective guide rails 12, causing sliding movement of the first gear rack 31 and the second gear rack 32 in reversed directions. During relative sliding movement between the first gear rack 31 and the second gear rack 32, the center gear 332 is driven by the series of teeth 311, 321 to rotate; the guide screws 3121, 3221 are respectively moved along the respective first sliding slots 312 and second sliding slots 322 to stabilize the sliding movement of the first gear rack 31 and the second gear rack 32, and thus, the table top 1 is lifted or lowered synchronously with the scissors action of the linkage system 2.

Further, when the coupling rods 212 of the linkage unit 21 are biased inwards or outwards, the meshed coupling gears 2121 drive the scissors linkages 211 to perform a scissors action smoothly, so that the linkage unit 21 of the linkage system 2 can be extended out or collapsed stably and smoothly without vibration on the base plate 23, enhancing stability and reliability of the adjustment of the height of the table top 1. Further, when the coupling rods 212 of the linkage unit 21 are outwardly biased to lower the elevation, the torsion springs 234 are driven to impart a pressure to the linkage unit 21, buffering to the speed of the downward movement of the table top 1, preventing the table top 1 from hitting the base plate 23 accidentally and stabilizing the sliding movement of the sliding roller sets 221 of the sliding roller unit 22. Further, when the user lifts the table top 1, the torsion springs 234 and the meshed coupling gears 2121 of the coupling rods 212 stabilize the synchronous scissors action of the scissors linkages 211 of the linkage unit 21, and the center gear 332 of the locking mechanism 33 drives the first gear rack 31 and the second gear rack 32 to move in the reversed directions. Thus, subject to the functioning of the linkage system 2, the table top 1 can be rapidly and stably lifted with less effort, i.e., the user can adjust the elevation of the table top 1 easily and efficiently with less effort.

After adjustment of the table top 1 to the desired elevation, the user can then release the hand from the operating lever 341 of the control unit 34, allowing the spring member 3432 of the buffer device 343 to return the arched engagement member 342 and the operating lever 341. As soon as the arched engagement member 342 is returned to its previous position, the pawl 3421 is forced into engagement with the center gear 332 to stop the center gear 332 from rotation. Further, when pawl 3421 is inserted through the positioning slot 3315 of the bracket 331 into engagement with the center gear 332, it is also partially engaged into the elongated position-limiting hole 112 of the mount 11 to lock the center gear 332 positively. As the center gear 332 is meshed with the series of teeth 311 of the first gear rack 31 and the series of teeth 321 of the second gear rack 32, the sliding roller sets 221 of the sliding roller unit 22 are stopped from movement relative to the guide rails 12. At this time, the linkage unit 21 supports the table top 1 positively in the adjusted height. The arrangement of the first gear rack 31 and the second gear rack 32 of the lifting control system 3 between the guide rails 12 beneath the mount 11 of the table top 1 allows the user to lift or lower the table top 1 in moving the linkage unit 21 of the linkage system 2 while operating the control unit 34 to unlock the locking mechanism 33, facilitating quick adjustment of the elevation of the table top 1. Thus, the single lever-operated height-adjustable table has the advantages of high structural stability and ease of operation.

As described above, the first gear rack 31 and the second gear rack 32 of the lifting control system 3 are mounted between the two guide rails 12 of the table top 1, and the center gear 33 of the locking mechanism 33 is meshed between the first gear rack 31 and the second gear rack 32; when the user forces down or lift the table top 1 to expand or collapse the linkage unit 21 of the linkage system 2, the sliding roller sets 221 of the sliding roller unit 22 are moved forward or backward in the sliding chambers 120 of the respective guide rails 12 to carry the first gear rack 31 and the second gear rack 32 in the reversed directions, and then, the center gear 332 of the locking mechanism 33 of the lifting control system 3 drive the first gear rack 31 and the second gear rack 32 to slide in the reversed directions, accelerating the moving speed of the scissors linkages 211 of the linkage unit 21 and the rising or lowering speed of the table top 1. Since the scissors linkages 211 of the linkage unit 21 are respectively and symmetrically disposed at opposing left and right side, the coupling rods 212 can be smoothly received to the base plate 23 to collapse the linkage system 2 into a flat condition without interference, thereby saving space occupation and facilitating delivery and storage.

In conclusion, the invention provides a single lever-operated height-adjustable table, which comprises a table top 1 with two bottom guide rails 12 arranged in parallel at a bottom mount 11 thereof, a base plate 23 holding a first pivot axle 232 and a second pivot axle 233 with torsion springs 234 respectively loaded on the first pivot axle 232 and the second pivot axle 233, a linkage system 2 including a linkage unit 21 consisting of two scissors linkages 211 with two pairs of coupling rods 212 pivotally coupled between the scissors linkages 211 and the first pivot axle 232 and the second pivot axle 233 at the base plate 23 and a sliding roller unit 22 consisting of sliding roller sets 221 that are respectively pivotally connected to the scissors linkages 211 and rotatably movably mounted in the guide rails 12, and a lifting control system 3 for controlling lifting of the table top 1 through one single operating lever 341. When the user biases the operating lever 341 of the control unit 34 of the lifting control system 3, the arched engagement member 342 of the lifting control system 3 is disengaged from a center gear 332 of a locking mechanism 33 of the lifting control system 3 to unlock the center gear 332. At this time, the torsion springs 234 of the linkage system 2 and the meshed coupling gears 332 at the bottom sides of the coupling rods 21 stabilize rapid rising of the linkage unit 21. At the same time, the center gear 332 drives the first gear rack 31 and the second gear rack 32 of the lifting control system 3 to move in reversed directions and to carry the sliding roller sets 221 along the respective guide rails 12, and thus, the table top 1 can be smoothly adjusted to the desired elevation with less effort.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A single lever-operated height-adjustable table, comprising:

a table top comprising a mount located at a bottom side thereof and two guide rails fixedly mounted at a bottom side of said mount in a parallel manner, each said guide rail defining therein a sliding chamber;

a linkage system comprising a linkage unit mounted at the bottom side of said mount, a sliding roller unit mounted at a top side of said linkage unit and slidably coupled to said guide rails and a base plate coupled with an opposing bottom side of said linkage unit, said linkage unit comprises two scissors linkages, and two pairs of coupling rods respectively pivotally connected with respective top ends thereof to said scissors linkages by respective bottom pivot bolts, said coupling rods having respective opposing bottom ends thereof respectively terminating in a coupling gear, said coupling gears of each said pair of said coupling rods being meshed together, said sliding roller unit comprising sliding roller sets respectively pivotally connected to said scissors linkages of said linkage unit by respective said pivot bolts and rotatably movably mounted in the said sliding chambers of the respective said guide rails, said base plate comprises a coupling rod supporting rack located at a center area of a top wall thereof for supporting said linkage unit, a first pivot axle and a second pivot axle transversely mounted at said coupling rod supporting rack and respectively inserted through said coupling gears of said coupling rods of said linkage unit to pivotally connect said coupling gears to said coupling rod supporting rack, and two torsion springs respectively mounted on said first pivot axle and said second pivot axle with respective opposite end pieces thereof respectively stopped at said base plate and the respective said coupling rod; and a lifting control system for controlling lifting of said table top, said lifting control system comprising a first gear rack and a second gear rack arranged in parallel between said two guide rails beneath said mount with respective series of teeth thereof facing toward each other, two connection plates respectively downwardly extended from one end of said first gear rack and one end of said second gear rack in a diagonal manner and respectively connected to the said sliding roller sets of said scissors linkages, a locking mechanism disposed between said first gear rack and said second gear rack, said locking mechanism comprising a bracket, a center gear pivotally mounted at the center of said bracket and meshed between said first gear rack and said second gear rack, and a control unit connected to said locking mechanism, said control unit comprising an operating lever, a coupling axle axially extended from a distal end of said operating lever and pivotally connected to said bracket, and an arched engagement member fastened to said coupling axle and adapted for engaging said center gear to stop said center gear from rotation, said arched engagement member being biasable by said operating lever to disengage from said center gear for allowing rotation of said center gear to move said first gear rack and said second gear rack in reversed direction and movement of said table top with said linkage system, wherein said mount of said table top comprises a mounting hole located at the center of said mount and equally spaced between said two guide rails; said center gear defines therein a center gear hole; said bracket of said locking mechanism of said lifting control system comprises a first axle hole axially aligned with said mounting hole of said mount and said center gear hole of said center gear; said locking mechanism further comprises a pivoting device mounted in said center gear hole to pivotally connect said center gear to said first axle hole and said mounting hole, wherein said mount further comprises an elongated position-limiting hole disposed near said mounting hole; an arched engagement member of a control unit comprises a pawl located at one end thereof and adapted for engaging said center gear and said elongated position-limiting hole to stop said center gear from rotation relative to said bracket and said mount, and wherein said mount further comprises a plurality of screw holes spaced around said mounting hole; a first gear rack and a second gear rack each comprise a series of teeth longitudinally located at an inner side thereof and meshed with said center gear and a connection plate perpendicularly downwardly extended from one end thereof and connected to one respective a sliding roller set, the two said connection plates being respectively extended from said first gear rack and said second gear rack in a diagonal manner, said first gear rack defining therein at least one first sliding slot, said second gear rack defining therein at least one second sliding slot; said lifting control system further comprises a plurality of guide screws respectively inserted through the said at least one first sliding slot and said at least one second sliding slot and threaded into the respective said screw holes of said mount to guide sliding movement of said first gear rack and said second gear rack relative to said mount.

2. The single lever-operated height-adjustable table as claimed in claim 1, wherein said pivoting device of said locking mechanism comprises a screw nut riveted to said mounting hole of said mount, and a screw upwardly inserted through said first axle hole of said bracket and said center gear hole of said center gear and threaded into said screw nut.

3. The single lever-operated height-adjustable table as claimed in claim 1, wherein each said guide rail of said table top comprises a top panel, two side panels respectively and vertically downwardly extended from two opposite lateral sides of said top panel, two guide flanges respectively and horizontally inwardly extended from respective bottom sides of said two side panels toward each other, and an elongated open slot defined between said two guide flanges in communication with the associating said sliding chamber; each said sliding roller set of said sliding roller unit comprises a mounting plate pivotally coupled to said linkage unit and upwardly inserted through said elongated open slot of one said guide rail, a plurality of wheel axles transversely mounted in said mounting plate, and a plurality of rollers respectively pivotally mounted on opposite ends of said wheel axle and rotatably supported on said guide flanges inside the respective said sliding chamber.

4. The single lever-operated height-adjustable table as claimed in claim 3, wherein each scissors linkage of said linkage unit comprises a first link, a second link and a center pivot pivotally connecting said first link and said second link into a criss-cross 'X' pattern; two pairs of coupling rods are respectively pivotally connected with respective top ends thereof to respective bottom ends of said first links and said second links of said scissors linkages by respective bottom pivot bolts; said two pairs of coupling rods have the respective top ends thereof respectively pivotally connected to respective bottom ends of said first links and said second links of said scissors linkages by the respective said bottom pivot bolts; said mounting plates of said sliding roller sets are respectively pivotally connected to the top end of said first links and said second links of said scissors linkages.

5. The single lever-operated height-adjustable table as claimed in claim 1, wherein each coupling rod comprises a side flange located at an inner side thereof; said coupling rod supporting rack of said base plate comprises two upright supporting plates arranged in parallel and holding said first pivot axle and said second pivot axle in parallel; said two torsion springs have the respective opposite end pieces thereof respectively stopped at said base plate and said side flanges of the respective said coupling rod.

6. The single lever-operated height-adjustable table as claimed in claim 1, wherein said bracket of said locking mechanism of said lifting control system further comprises two side panels respectively downwardly extended from two opposite lateral sides thereof in a parallel manner, a second axle hole transversely cut through the said two side panels of said bracket, two horizontal mounting lugs respectively extended from opposing front and rear sides thereof and fastened to said mount, a positioning slot cut through one said horizontal mounting lug, and a top accommodation space defined between said two horizontal mounting lugs for accommodating said center gear; said arched engagement member of said control unit comprises a pawl located at one end thereof and movable through said positioning slot to engage said center gear.

7. The single lever-operated height-adjustable table as claimed in claim 6, wherein said arched engagement member of said control unit further comprise a bearing portion located at an opposite end thereof remote from said pawl, and a through hole cut through said bearing portion and a buffer device mounted in said through hole, said buffer device comprising a push bolt upwardly inserted through said through hole, a screw nut threaded onto said push bolt for abutment against said bracket, and a spring member mounted around said push bolt with two opposite ends thereof respectively stopped against said bearing portion and the said screw nut.

* * * * *